US008384598B2

(12) United States Patent
Harihara et al.

(10) Patent No.: US 8,384,598 B2
(45) Date of Patent: Feb. 26, 2013

(54) SURFACE-MOUNTED ANTENNA, ANTENNA DEVICE USING THE SAME, AND RADIO COMMUNICATION EQUIPMENT

(75) Inventors: Yasumasa Harihara, Tokyo (JP); Tetsuzo Goto, Tokyo (JP); Toshihiro Tsuru, Tokyo (JP); Masaki Matsushima, Tokyo (JP)

(73) Assignee: TDK Corporation, Tokyo (JP)

( * ) Notice: Subject to any disclaimer, the term of this patent is extended or adjusted under 35 U.S.C. 154(b) by 694 days.

(21) Appl. No.: 12/607,229

(22) Filed: Oct. 28, 2009

(65) Prior Publication Data

US 2010/0103057 A1 Apr. 29, 2010

(30) Foreign Application Priority Data

Oct. 28, 2008 (JP) ..... 2008-276706

(51) Int. Cl.
*H01Q 1/24* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 6,323,811 | B1 * | 11/2001 | Tsubaki et al. | 343/700 MS |
| 6,433,745 | B1 * | 8/2002 | Nagumo et al. | 343/700 MS |
| 6,501,425 | B1 | 12/2002 | Nagumo et al. | |
| 6,614,398 | B2 * | 9/2003 | Kushihi et al. | 343/700 MS |
| 7,196,667 | B2 | 3/2007 | Watada et al. | |
| 8,111,194 | B2 * | 2/2012 | Chang et al. | 343/700 MS |
| 2004/0075614 | A1 | 4/2004 | Dakeya et al. | |
| 2009/0273531 | A1 | 11/2009 | Ishizuka et al. | |
| 2009/0303140 | A1 | 12/2009 | Sato et al. | |

FOREIGN PATENT DOCUMENTS

| | | | |
|---|---|---|---|
| EP | 1569300 | A | 8/2005 |
| JP | 2006-67259 | | 3/2006 |
| WO | 01/18909 | A1 | 3/2001 |
| WO | 2008/087780 | A1 | 7/2008 |
| WO | 2008087780 | A | 7/2008 |
| WO | 2008126724 | A | 10/2008 |
| WO | 2008126724 | A1 | 10/2008 |

OTHER PUBLICATIONS

Extended European Search Report of Dec. 11, 2009 in EP application 09013523.7.

* cited by examiner

*Primary Examiner* — Tho G Phan
(74) *Attorney, Agent, or Firm* — Young Law Firm, P.C.

(57) ABSTRACT

A surface-mounted antenna has a base having a substantially rectangular parallelepiped shape, an antenna element formed on the surface of the base and having a first radiation electrode subjected to direct power supply, and an antenna element formed on the surface of the base and having a radiation electrode subjected to capacitive coupling power supply. With this, the smaller surface-mounted antenna of a combo antenna type can be provided.

9 Claims, 11 Drawing Sheets

SURFACE-MOUNTED ANTENNA, ANTENNA DEVICE USING THE SAME, AND RADIO COMMUNICATION EQUIPMENT

TECHNICAL FIELD

The present invention relates to a surface-mounted antenna, an antenna device using the same, and radio communication equipment. More specifically, the present invention relates to a surface-mounted antenna of a combo antenna type with two power supply electrodes and two radiation electrodes, an antenna device using the same, and radio communication equipment.

BACKGROUND OF THE INVENTION

In recent years, compact communication terminal devices such as cellular phones which solely cope with plural radio communication systems using a surface-mounted antenna, such as wireless LAN, GPS, and Bluetooth, have appeared. The frequencies of electric waves used by these radio communication systems are typically different from each other. Plural surface-mounted antennas are provided in one compact mobile terminal device, which cannot make the compact communication terminal device smaller. The study for coping with the plural radio communication systems of different frequencies by one surface-mounted antenna is being advanced.

One of the candidates of such surface-mounted antennas which are now being studied is of a combo antenna type with two power supply electrodes and two radiation electrodes. This has two radiation electrodes on one base surface so that they are not overlapped with each other and supplies power to each of them. Its specific example is described in FIG. 6 of Japanese Patent Application Laid-Open (JP-A) No. 2006-67259.

SUMMARY OF THE INVENTION

In the surface-mounted antenna of a combo antenna type, the two radiation electrodes need be provided so as to be spaced apart from each other to some extent in order to avoid the interference of an electromagnetic field. It is difficult to make the surface-mounted antenna itself smaller.

Accordingly, an object of the present invention is to provide a smaller surface-mounted antenna of a combo antenna type, an antenna device using the same, and radio communication equipment.

A surface-mounted antenna according to the present invention to achieve the above object has a base having a substantially rectangular parallelepiped shape, a first antenna element formed on the surface of the base and having a first radiation electrode subjected to direct power supply, and a second antenna element formed on the surface of the base and having a second radiation electrode subjected to capacitive coupling power supply.

According to the present invention, the phase of an electric current flowing through the second radiation electrode is advanced by 90° as compared with the phase of an electric current flowing through the first radiation electrode. The interference of an electromagnetic field between the first and second antenna elements is thus reduced. This allows the first and second radiation electrodes to be arranged closer to each other. Therefore, the smaller surface-mounted antenna of a combo antenna type can be provided.

In the surface-mounted antenna, the first antenna element may further have a first power supply electrode which directly connects a first power supply line formed on a substrate on which the surface-mounted antenna is provided and the first radiation electrode, and the second antenna element may further have a second power supply electrode which connects a second power supply line formed on the substrate and the second radiation electrode via a gap. With this structure, the direct power supply of the first radiation electrode and the capacitive coupling power supply of the second radiation electrode can be realized.

In the surface-mounted antenna, a first ground pattern connected to the first power supply line may be formed on the substrate, the first antenna element may further have a first conductor having one end contacted with the first radiation electrode and the other end not contacted with other conductors, the second antenna element may further have a second conductor which connects the second radiation electrode and the first ground pattern. The second power supply electrode may be formed on a first surface of the base, and the first conductor may be formed on a second surface orthogonal to the first surface of the base. With this, the other end of the first conductor configures the open end of the first antenna element, and the conductor end of the gap located on the second radiation electrode side configures the open end of the second antenna element. The open ends are formed on the two surfaces of the base formed at an angle of 90°. The characteristics of the first and second antenna elements can be accordingly improved.

In the surface-mounted antenna, the first and second radiation electrodes may be extended in parallel with each other from one end of the substrate to the other end thereof, and the first power supply electrode and the second conductor may be contacted with the first and second radiation electrodes in the portions closer to the other end of the base, respectively. With this structure, when the base is provided near the corner portion of the substrate, both the short stubs of the first and second antenna elements (the first power supply electrode and the second conductor) can be arranged closer to the corner portion of the substrate. The substrate can be efficiently used together with the first and second antenna elements. The antenna efficiencies can be accordingly improved.

In each of the surface-mounted antennas, the base may have convex surfaces protruded with respect to a different portion on the surfaces on which the first and second radiation electrodes are provided, and the first and second radiation electrodes may be provided on the convex surfaces. With this structure, the volume of the base can be reduced, the antenna characteristic can be improved, and the position shift when the radiation electrodes are formed by screen printing can be prevented.

An antenna device according to the present invention has anyone of the surface-mounted antennas and the substrate.

In the antenna device, the substrate may have plural land patterns at a ground potential in the provided region of the surface-mounted antenna. With this structure, an electric current flowing through each of the conductors on the base can be forcefully guided to the ground. The interference of an electromagnetic field between the first and second antenna elements can be reduced.

In the antenna device, the substrate may have a second ground pattern provided on the back side thereof, and plural throughhole conductors which connect the second ground pattern and the face side thereof, wherein each of the plural land patterns may be connected to the second ground pattern by any one of the plural throughhole conductors. By this, the wiring of the face side can be prevented from becoming complicated.

Radio communication equipment according to the present invention has any one of the antenna devices.

According to the present invention, the smaller surface-mounted antenna of a combo antenna type can be provided.

Preferred embodiments of the present invention will be described below in detail with reference to the accompanying drawings.

BRIEF DESCRIPTION OF THE DRAWINGS

FIGS. 3A and 3B are plan views showing the configuration of a substrate according to the first embodiment of the present invention, in which FIG. 3A is a plan view of the face side of the substrate (the surface on which the surface-mounted antenna is provided) and FIG. 3B is a plan view of the back side of the substrate;

FIGS. 7A and 7B are plan views showing the configuration of the substrate according to the second embodiment of the present invention, in which FIG. 7A is a plan view of the face side of the substrate (the surface on which the surface-mounted antenna is provided) and FIG. 7B is a plan view of the back side of the substrate;

DESCRIPTION OF THE PREFERRED EMBODIMENTS

First Embodiment

Figure 1:
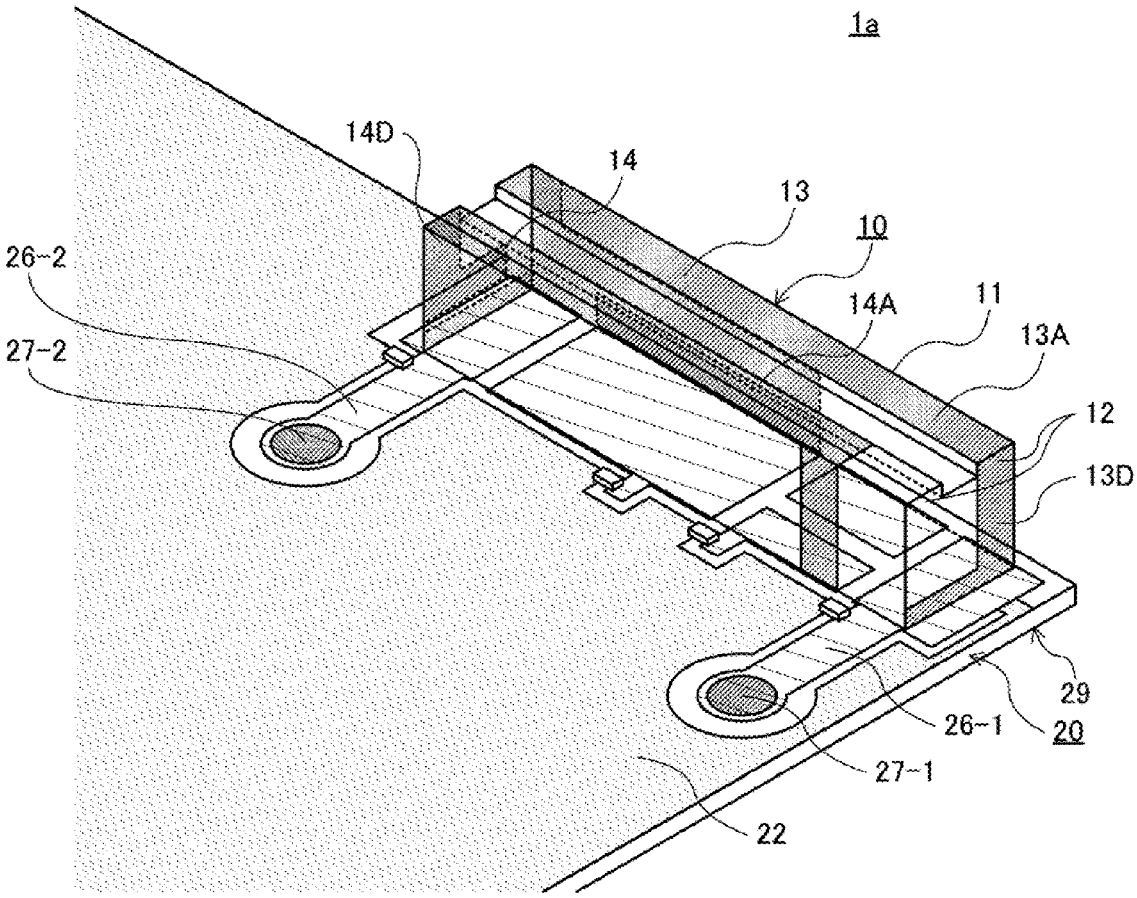
FIG. 1 is a perspective view showing the configuration of an antenna device according to a first embodiment of the present invention.
Figure 2:
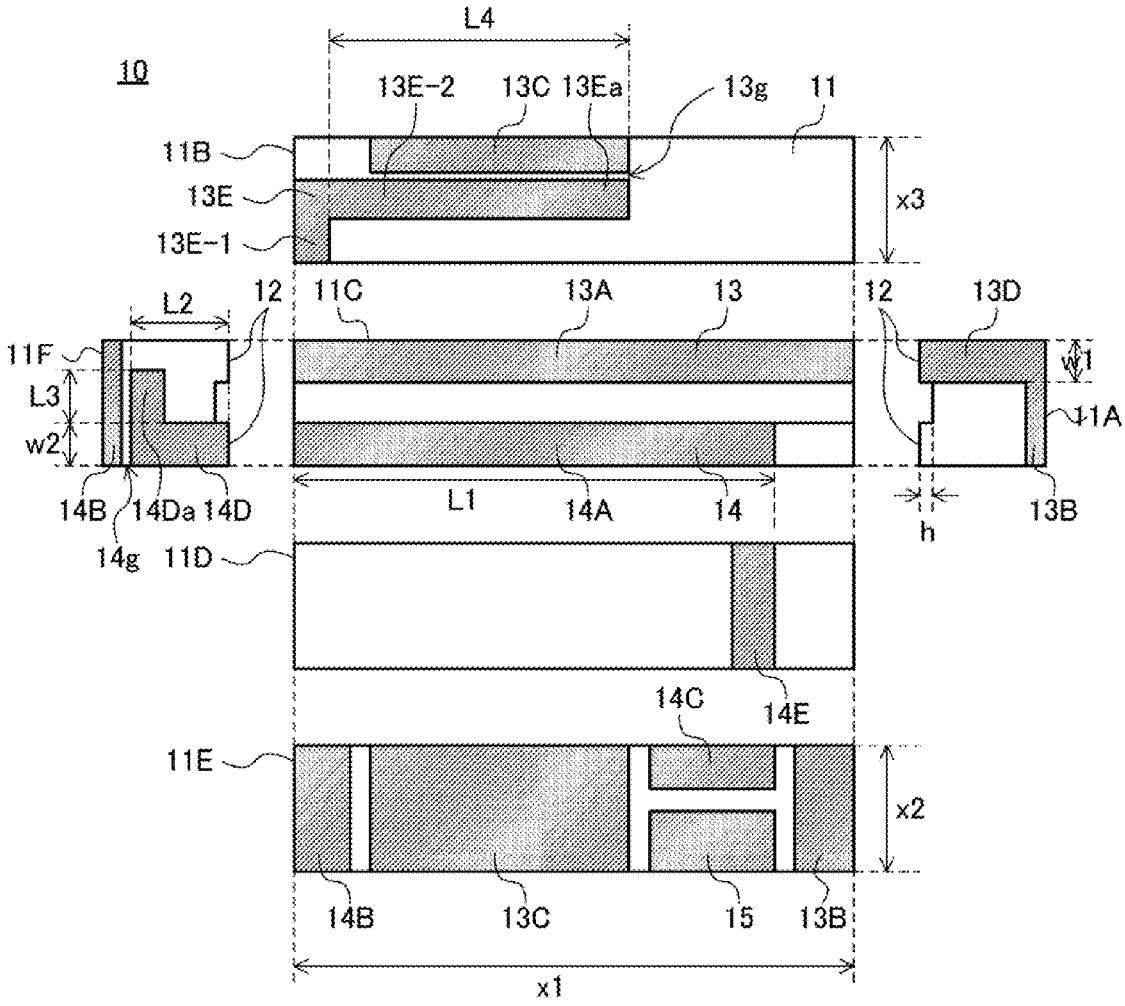
FIG. 2 is a developed view of a surface-mounted antenna according to the first embodiment of the present invention.
Figure 3A:
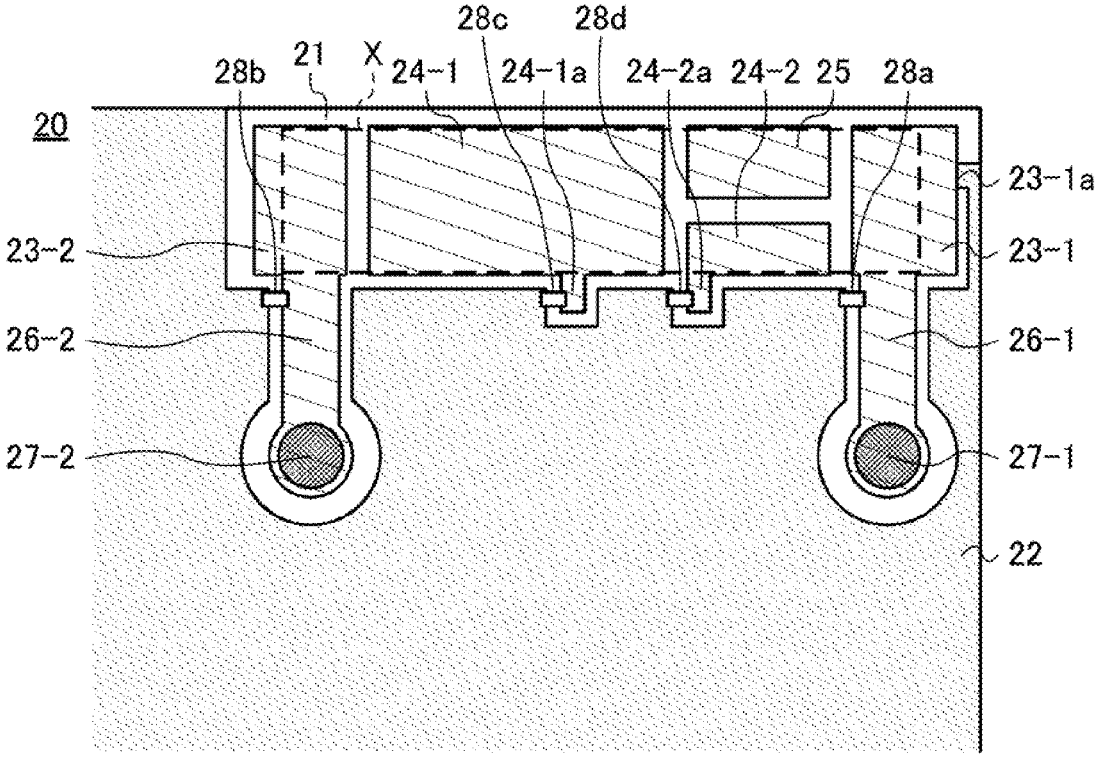
Figure 3B:
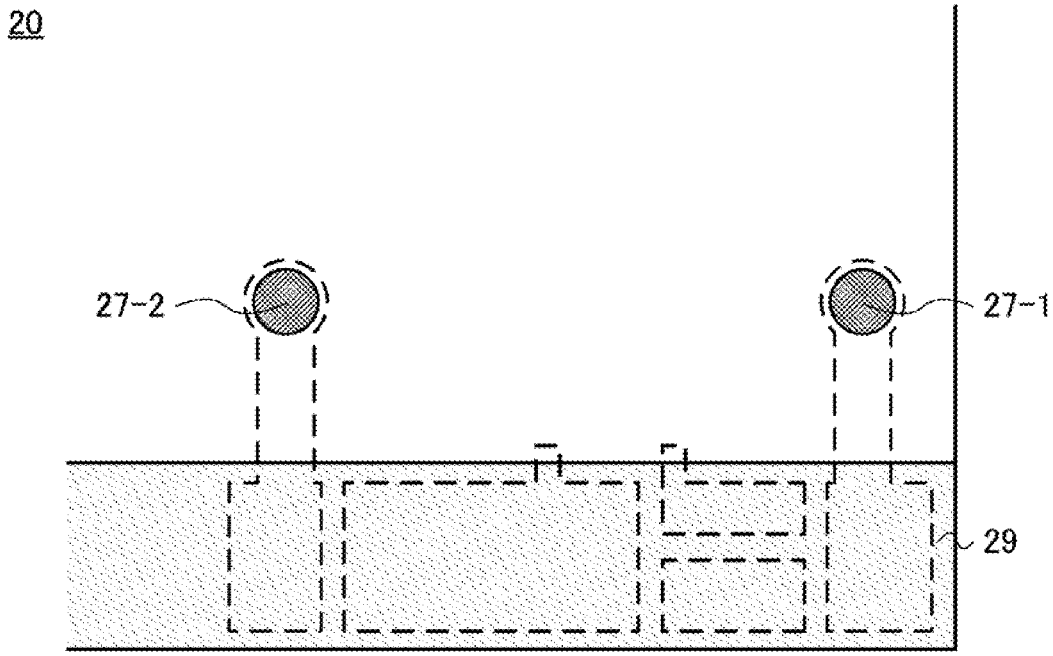

FIG. 1 is a perspective view showing the configuration of an antenna device 1*a* according to a first embodiment of the present invention. As shown in FIG. 1, the antenna device 1*a* has a surface-mounted antenna 10, and a substrate 20 on which the surface-mounted antenna 10 is provided. FIG. 2 shows a developed view of the surface-mounted antenna 10. FIGS. 3A and 3B show plan views showing the configuration of the substrate 20. FIG. 3A is a plan view of the face side of the substrate 20 (the surface on which the surface-mounted antenna 10 is provided). FIG. 3B is a plan view of the back side of the substrate 20. The antenna device 1*a* is mounted on compact radio communication equipment such as a cellular phone.

As shown in FIGS. 1 and 2, the surface-mounted antenna 10 has a base 11 made of a dielectric having a substantially rectangular parallelepiped shape, and an antenna element 13 (a first antenna element) and an antenna element 14 (a second antenna element) configured by conductors on the surface of the base 11. As shown in FIG. 1, the surface-mounted antenna 10 is provided near the corner portion of the substrate 20.

The term "substantially rectangular parallelepiped shape" is intended to include, not only a complete rectangular parallelepiped shape, but also a partially incomplete rectangular parallelepiped one. In this embodiment, the base 11 has convex surfaces 12 protruded by a height h with respect to a different portion on a top surface 11C and does not have the complete rectangular parallelepiped shape.

The size of the base 11 should be appropriately set according to a target antenna characteristic. Without being limited, lateral lengths x1 and x2 (x1>x2) can be 14 mm and 3 mm, respectively, and a height x3 can be 3 mm. Without being limited, as the materials of the base 11, it is preferable to use dielectric materials such as a Ba—Nd—Ti material (a dielectric constant of 80 to 120), an Nd—Al—Ca—Ti material (a dielectric constant of 43 to 46), an Li—Al—Sr—Ti (a dielectric constant of 38 to 41), a Ba—Ti material (a dielectric constant of 34 to 36), a Ba—Mg—W material (a dielectric constant of 20 to 22), an Mg—Ca—Ti material (a dielectric constant of 19 to 21), sapphire (a dielectric constant of 9 to 10), alumina ceramics (a dielectric constant of 9 to 10), and cordierite ceramics (a dielectric constant of 4 to 6). The base 11 is manufactured by calcining these materials using a die.

The dielectric materials to be specifically used may be appropriately selected according to the used frequencies of the radio communication systems described below to use the antenna elements 13 and 14. As a dielectric constant $\in r$ is larger, a higher wavelength shortening effect can be obtained. The length of the radiation conductors can be accordingly shortened. When the dielectric constant $\in r$ is too large, however, the antenna gain is reduced. It is, thus, preferable to determine the optimum dielectric material by observing the balance of these. By way of example, when the antenna element 13 is used for GPS reception and the antenna element 14 is used for wireless LAN communication of IEEE802.11b, it is preferable to use the dielectric material having a dielectric constant of about 5 to 40. As such a dielectric material, the Mg—Ca—Ti dielectric ceramic can be preferable. As the Mg—Ca—Ti dielectric ceramic, it is particularly preferable to use the Mg—Ca—Ti dielectric ceramic containing $TiO_2$, MgO, CaO, MnO, and $SiO_2$.

The antenna element 13 has a radiation electrode 13A (a first radiation electrode) formed on the top surface 11C of the base 11, a conductor 13B formed continuously from a side surface 11A (the side surface vertical to a longitudinal direction) to a bottom surface 11E, a conductor 13C formed continuously from a side surface 11B (the side surface in parallel with a longitudinal direction) to the bottom surface 11E of the base 11, a power supply electrode 13D (a first power supply electrode) formed on the side surface 11A, and a conductor 13E (a first conductor) formed on the side surface 11B. The antenna element 19 has a radiation electrode 14A (a second radiation electrode) formed on the top surface 11C of the base 11, a conductor 14B formed continuously from a side surface 11F (the side surface opposite to the side surface 11A) to the bottom surface 11E, a conductor 14C formed on the bottom surface 11E, a power supply electrode 14D (a second power supply electrode) formed on the side surface 11F, and a conductor 14E (a second conductor) formed on a side surface 11D (the side surface opposite to the side surface 11B). It is preferable to form these electrodes and conductors by screen printing.

The radiation electrodes 13A and 14A are extended in parallel with each other from one end in a longitudinal direction of the base 11 (the end on the side surface 11F side) toward the other end thereof on the convex surfaces 12 provided to the top surface 11C. The convex surfaces 12 include a convex surface having a constant width of w1 along the boundary between the top surface 11C and the side surface 11B, and a convex surface having a constant width w2 along the boundary between the top surface 11C and the side surface 11D. The radiation electrode 13A is formed on the entire convex surface having the constant width w1. The radiation electrode 13A has a rectangular conductor pattern whose width is equal to w1 and whose length is equal to the entire length in a longitudinal direction of the base 11. The radiation electrode 14A is formed on the convex surface having the constant width w2 from the one end of the base 11 (the end on the side surface 11F side) to only the portion at a predetermined distance L1 (<x1) which is shorter than the entire length in a longitudinal direction of the base 11. The radiation electrode 13A has a rectangular conductor pattern whose width is equal to w2 and whose length is L1.

Each of the conductors 13B and 14B has a rectangular conductor pattern which is formed throughout the entire width of the bottom surface 11E at the end on the side surface 11A side or the end on the side surface 11F side in a longitudinal direction of the bottom surface 11E and is extended to the vicinity of the boundary between the side surface 11A or 11F and the bottom surface 11E.

The conductors 13C and 14C have rectangular conductor patterns provided in this order between the conductors 14B and 13B. The conductor 13C is formed throughout the entire width of the bottom surface 11E and is extended to the vicinity of the boundary between the side surface 11B and the bottom surface 11E. The conductor 14C is not formed throughout the entire width of the bottom surface 11E and is formed at a constant width near the boundary between the bottom surface 11E and the side surface 11D.

A conductor 15 has a rectangular conductor pattern formed in a region resulting from the conductor 14C not formed throughout the entire width of the bottom surface 11E. The conductor 15 is not contacted with other conductors on the surface of the base 11.

The power supply electrode 13D is formed on the side surface 11A at the constant width w1 along the boundary between the side surfaces 11A and 11B. The upper end of the power supply electrode 13D is contacted with the radiation electrode 13A and the lower end thereof is contacted with the conductor 13B. The power supply electrode 14D is formed on the side surface 11F at the constant width w2 along the boundary between the side surfaces 11F and 11D. The upper end of the power supply electrode 14D is contacted with the radiation electrode 14A and the lower end thereof is not contacted with the conductor 14B. A gap 14*g* having a predetermined width is provided between the power supply electrode 14D and the conductor 14B. The vertical length of the power supply electrode 14D is set to L2. The power supply electrode 14D is extended along the gap 14*g* by a length L3 to an end 14Da toward the side surface 11B.

The conductor 13E is provided on the side surface 11B, and has a portion 13E-1 formed at the constant width w1 to the vicinity of the center in a vertical direction of the side surface 11B along the boundary between the side surfaces 11B and 11F and a portion 13E-2 having a length L4 and formed at the constant width w1 from the lower end of the portion 13E-1 to an end 13Ea in the vicinity of the center of the side surface 11B. The portion 13E-2 and the conductor 13C are not contacted and a gap 13*g* having a predetermined width is provided therebetween. The conductor 14E has a rectangular conductor pattern provided on the side surface 11D from top to bottom. The width of the conductor 14E is w2 equal to the width of the radiation electrode 14A. The upper end of the conductor 14E is contacted with the radiation electrode 14A and the lower end thereof is contacted with the conductor 14C.

As shown in FIGS. 1, 3A, and 3B, the substrate 20 has, on its face side, a ground clearance region 21 not provided with a ground pattern, a ground pattern 22 (a first ground pattern) provided around the ground clearance region 21, land patterns 23-1 and 23-2, 24-1 and 24-2, and 25 provided in the ground clearance region 21, power supply lines 26-1 and 26-2 connected to the land patterns 23-1 and 23-2, respectively, and throughhole conductors 27-1 and 27-2 which guide the power supply lines 26-1 and 26-2 to the back side of the substrate 20, and has, on its back side, a ground pattern 29 (a second ground pattern). A region X indicated by the dashed line of the ground clearance region 21 is the region onto which the surface-mounted antenna 10 is provided (provided region). Although not shown, other various electronic components for configuring radio communication equipment are mounted on the substrate 20.

The ground clearance region 21 is provided along the corner portion of the substrate 20. Two directions around the ground clearance region 21 are surrounded by the ground pattern 22. Other two directions form an open space in which the substrate 20 does not exist.

The ground pattern 29 on the back side exists immediately below the region X. The surface-mounted antenna 10 is of the so-called on-ground type.

The land patterns 23-1 and 23-2 are provided in the positions corresponding to the conductors 13B and 14B of the surface-mounted antenna 10, respectively, and are solder connected to these conductors. The land pattern 23-1 is contacted with the ground pattern 22 at an end 23-1*a* so that the power supply line 26-1 and the ground pattern 22 are connected. The land patterns 24-1 and 24-2 are provided in the positions corresponding to the conductors 13C and 14C of the surface-mounted antenna 10, respectively, and are solder connected to these conductors. The land pattern 25 is provided in the position corresponding to the conductor 15 of the surface-mounted antenna 10 and is solder connected to the conductor 15.

The power supply lines 26-1 and 26-2 are connected to the land patterns 23-1 and 23-2, respectively. Chip reactors 28*a* and 28*b* for impedance adjustment are mounted between the power supply lines 26-1 and 26-2 and the ground pattern 22. The chip reactors 28*a* and 28*b* are preferably mounted in the positions outside the ground clearance region 21 and as closely as possible to the ground clearance region 21. The power supply lines 26-1 and 26-2 are introduced into the back side by the throughhole conductors 27-1 and 27-2 and are connected to signal lines (not shown) on the back side.

Chip reactors 28*c* and 28*d* for frequency adjustment are mounted between the land patterns 24-1 and 24-2 and the ground pattern 22, respectively. The chip reactors 28*c* and 28*d* are inserted in series between lead portions 24-1*a* and 24-2*a* of the land patterns 24-1 and 24-2 and the ground pattern 22, respectively. The chip reactors 28*c* and 28*d* are preferably mounted in the positions outside the ground clearance region 21 and as closely as possible to the ground clearance region 21.

The chip reactor 28*d* need be an inductor, a capacitor, or a short circuit. As will be described later, the conductors 14C and 14E function as the short stubs in the antenna element 14. This is realized by connecting the conductors 14C and 14E to the ground pattern 22.

The land pattern 25 is not connected to other patterns of the substrate 20 and is in a floating state.

The surface-mounted antenna 10 and the substrate 20 have the above-described configurations. The antenna elements 13 and 19 function as an inverted-F antenna. In the antenna element 13, the power supply electrode 13D and the conductor 13B function as the short stubs of the inverted-F antenna, and the end 13Ea of the conductor 13E on the gap 13*g* side functions as the open end of the inverted-F antenna. In the antenna element 14, the conductors 14E and 14C function as the short stubs of the inverted-F antenna, and the end 14Da of the conductor 14D on the gap 14*g* side functions as the open end of the inverted-F antenna.

The resonance frequencies of the antenna elements 13 and 19 are determined by the lengths and widths of the conductors formed on the surface of the base 11 and the apparent dielectric constant of the base 11. In the antenna device 1*a*, fine adjustment of the resonance frequencies is enabled by appropriately adjusting the reactances of the chip reactors 28*c* and 28*d*.

The antenna element 13 relatively located outside the substrate 20 is preferably used for the radio communication system of a relatively low frequency. The antenna element 14 relatively located inside the substrate 20 is preferably used for the radio communication system of a relatively high frequency. By way of example, when they cope with GPS reception using a frequency in a 1.5 GHz bandwidth and IEEE802.11b communication using a frequency in a 2.5 GHz bandwidth, it is preferable that the resonance frequency of the antenna element 13 be adjusted to the 1.5 GHz bandwidth and that the resonance frequency of the antenna element 14 be adjusted to the 2.5 GHz bandwidth.

The surface-mounted antenna 10 has a characteristic in the power supply method of the radiation electrodes 13A and 14A. The radiation electrode 13A is subjected to direct power supply and the radiation electrode 14A is subjected to capacitive coupling power supply. Here, direct power supply means that the radiation electrode and the power supply line on the substrate 20 are connected by a series of continuous conductors (direct connection), and the capacitive coupling power supply means that the radiation electrode and the power supply line on the substrate are connected via the gap (capacitive coupling connection).

Specifically, the power supply line 26-1, the land pattern 23-1, the conductor 13B, the power supply electrode 13D, and the radiation electrode 13A become a series of continuous conductors, thereby realizing the direct power supply of the radiation electrode 13A. The power supply line 26-2, the land pattern 23-2, the conductor 14B, the power supply electrode 14D, and the radiation electrode 14A become a series of continuous conductors except that they have the gap 14*g* partway, thereby realizing the capacitive coupling power supply of the radiation electrode 14A.

By using the above power supply method, the phase of an electric current flowing through the radiation electrode 14A is advanced by 90° as compared with an electric current flowing through the radiation electrode 13A. The interference of an electromagnetic field between the antenna elements 13 and 14 can be reduced. As compared with the case of using the same power supply method for both the radiation electrodes, the radiation electrodes 13A and 14A can be closer to each other. The smaller surface-mounted antenna of a combo antenna type can be provided.

Figure 4:
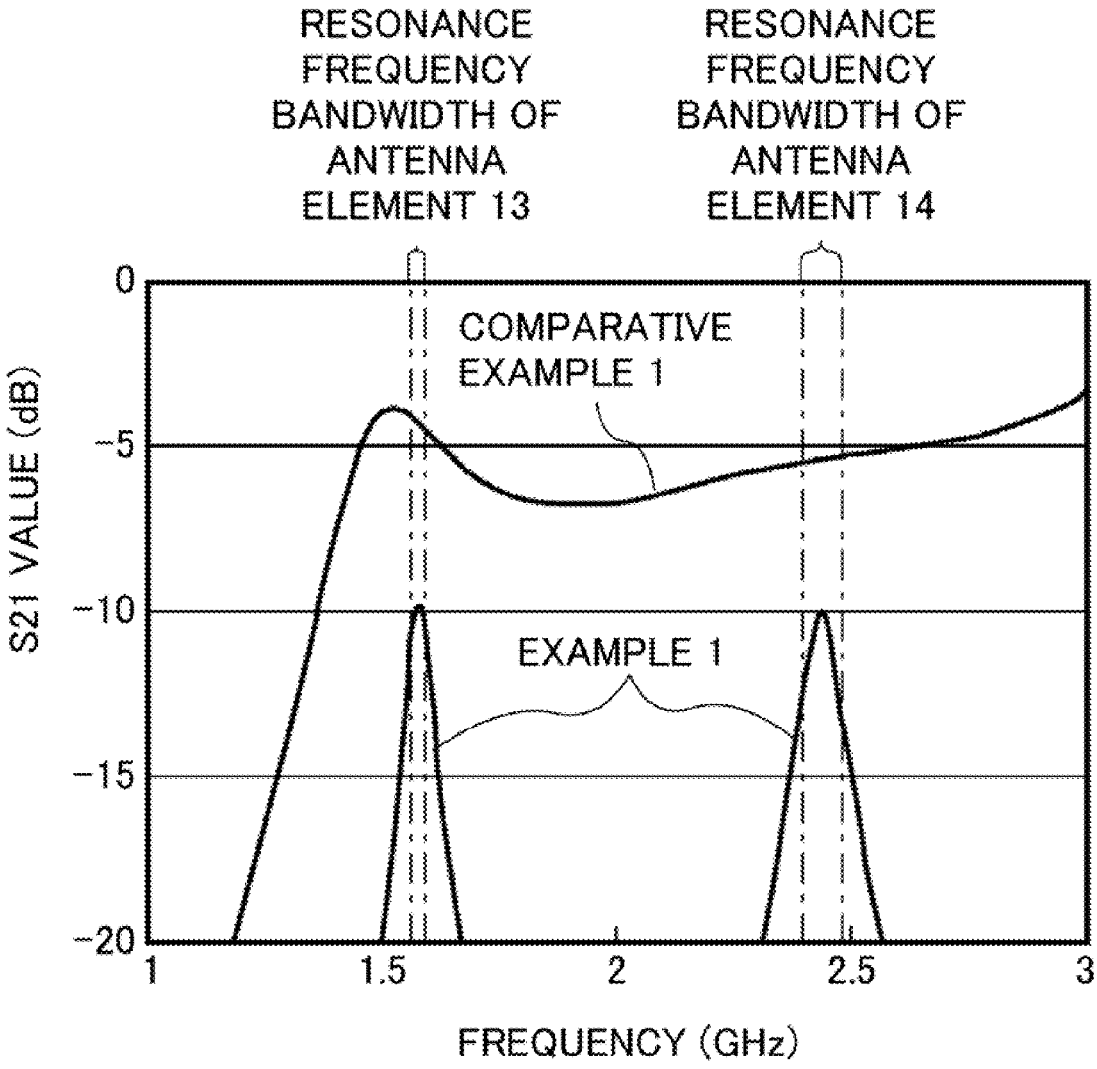
FIG. 4 is a graph showing the comparison of the characteristic of the surface-mounted antenna according to the first embodiment of the present invention (Example 1) with the characteristic of the surface-mounted antenna according to Comparative Example 1.

FIG. 4 is a graph showing the comparison of the characteristic of the surface-mounted antenna 10 according to this embodiment (Example 1) and the characteristic in which the gap 14*g* is eliminated from the surface-mounted antenna 10 and the conductors 14E and 14C are separated from each other (Comparative Example 1). The horizontal axis indicates a frequency and the vertical axis indicates the rate of the amplitude of a signal outputted from the power supply line 26-2 when the signal is inputted from the power supply line 26-1 (called an "S21 value"). This graph shows that the interference of an electromagnetic field between the antenna elements 13 and 14 is reduced as the value is smaller.

Figure 10:
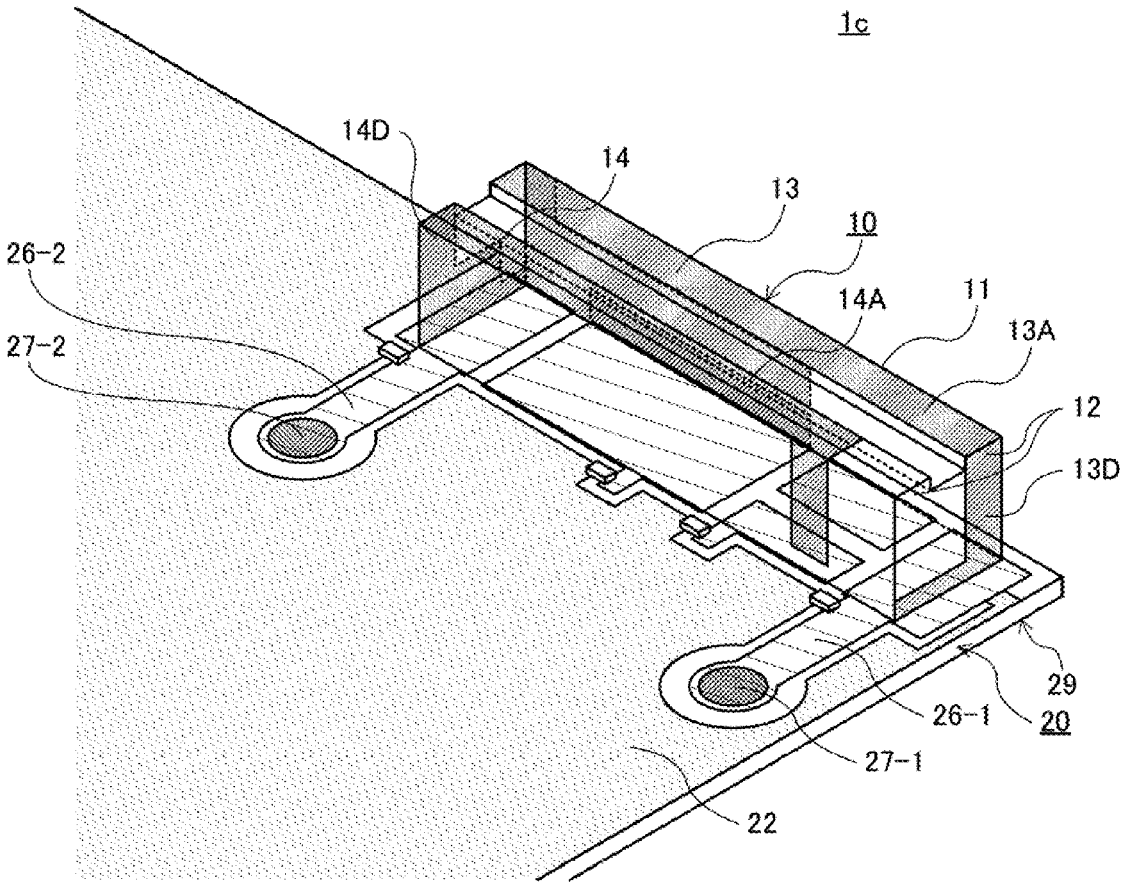
FIG. 10 is a perspective view showing the configuration of an antenna device according to Comparative Example 1 of the present invention.
Figure 11:
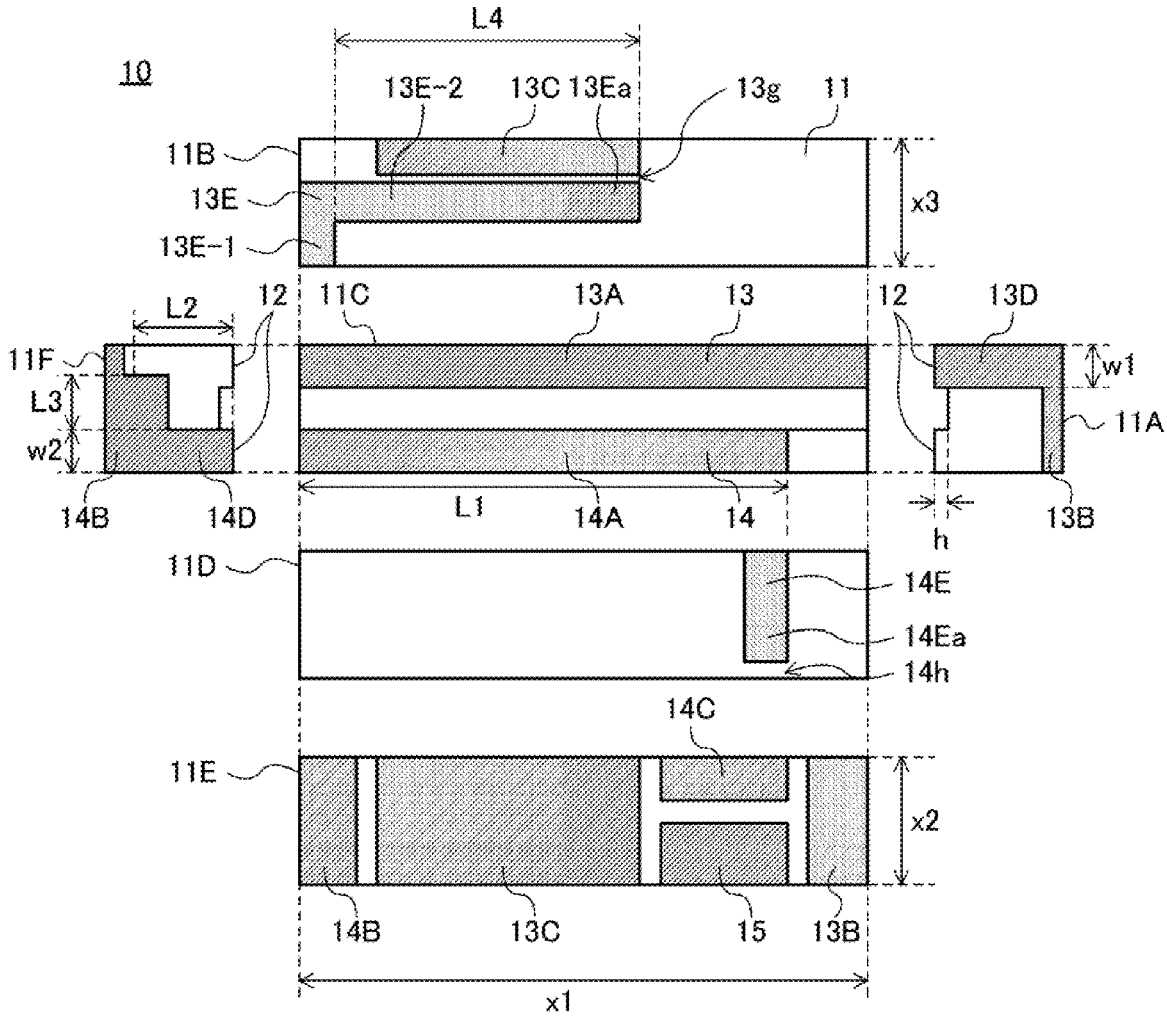
FIG. 11 is a developed view of the surface-mounted antenna according to Comparative Example 1 of the present invention.

FIG. 10 shows a perspective view showing the configuration of an antenna device is according to Comparative Example 1. FIG. 11 shows a developed view of the surface-mounted antenna 10 according to Comparative Example 1. As shown in these drawings, in Comparative Example 1, the gap 14*g* is eliminated, the conductor 14B and the power supply electrode 14D are contacted, a gap 14*h* is provided between the conductors 14C and 14E, and these are separated. The short stubs and the open ends of the antenna element 19 of Example 1 and Comparative Example 1 are inverted with respect to each other. In the antenna element 14, an end 14Ea of the conductor 14E on the gap 14*h* side functions as the open end of the inverted-F antenna, and the conductors 14D and 14B function as the short stubs of the inverted-F antenna.

In performing the measurement of characteristic shown in FIG. 4, the lengths and the like of the respective portions are adjusted to obtain the best characteristic. Specifically, x1=14 mm, x2=3 mm, x3=3 mm, w1=1 mm, w2=1 mm, L1=11.9 mm, L2=2.2 mm, L3=1.0 mm, L4=8.9 mm, h=0.2 mm, and the widths of the gaps 13*g*, 14*g*, and 14*h* are 0.4 mm, 0.3 mm, and 1.0 mm, respectively.

As shown in FIG. 4, the S21 values of Example 1 are smaller than those of Comparative Example 1 in the entire range (1 to 3 GHz) of the measured frequencies including the resonance frequency bandwidths of the antenna elements 13 and 14. By this, it is understood that the interference of an electromagnetic field between the antenna elements 13 and 14 of Example 1 is smaller than that of Comparative Example 1.

As described above, in the surface-mounted antenna 10 and the antenna device 1*a* using the same, the radiation electrode 13A is subjected to direct power supply and the radiation electrode 14A is subjected to capacitive coupling power supply. The interference of an electromagnetic field between the antenna elements 13 and 14 is smaller than the related art. The radiation electrodes 13A and 14A can be closer to each other. The smaller surface-mounted antenna of a combo antenna type can be provided.

In the surface-mounted antenna 10, the open ends (the ends 13Ea and 14Da) of the antenna elements 13 and 14 are formed on the two surfaces (the side surfaces 11B and 11F) of the base 11 formed at an angle of 90°. The antenna characteristics of the antenna elements 13 and 14 can be improved.

In the surface-mounted antenna 10, both the short stubs of the antenna elements 13 and 14 (the power supply electrode 13D and the conductor 13B in the antenna element 13 and the conductors 14E and 14C in the antenna element 14) can be closer to the corner portion of the substrate 20. The inverted-F antenna is an antenna using an image generated on the substrate via the short stubs. In the surface-mounted antenna 10, both the short stubs of the antenna elements 13 and 14 are located at the corner portion of the substrate 20. Both the antenna elements 13 and 14 can realize efficient image generation. The antenna efficiencies of the antenna elements 13 and 14 can be thus improved.

The convex surfaces 12 for forming the radiation electrodes are provided to the top surface 11C of the base 11. The position shift when the radiation electrodes are formed by screen printing can be prevented. The portion between the radiation electrodes is relatively recessed. This reduces the volume of the base 11. The antenna characteristic can be therefore improved. The interference of an electromagnetic field between the antenna elements 13 and 14 can also be reduced.

Second Embodiment

Figure 5:
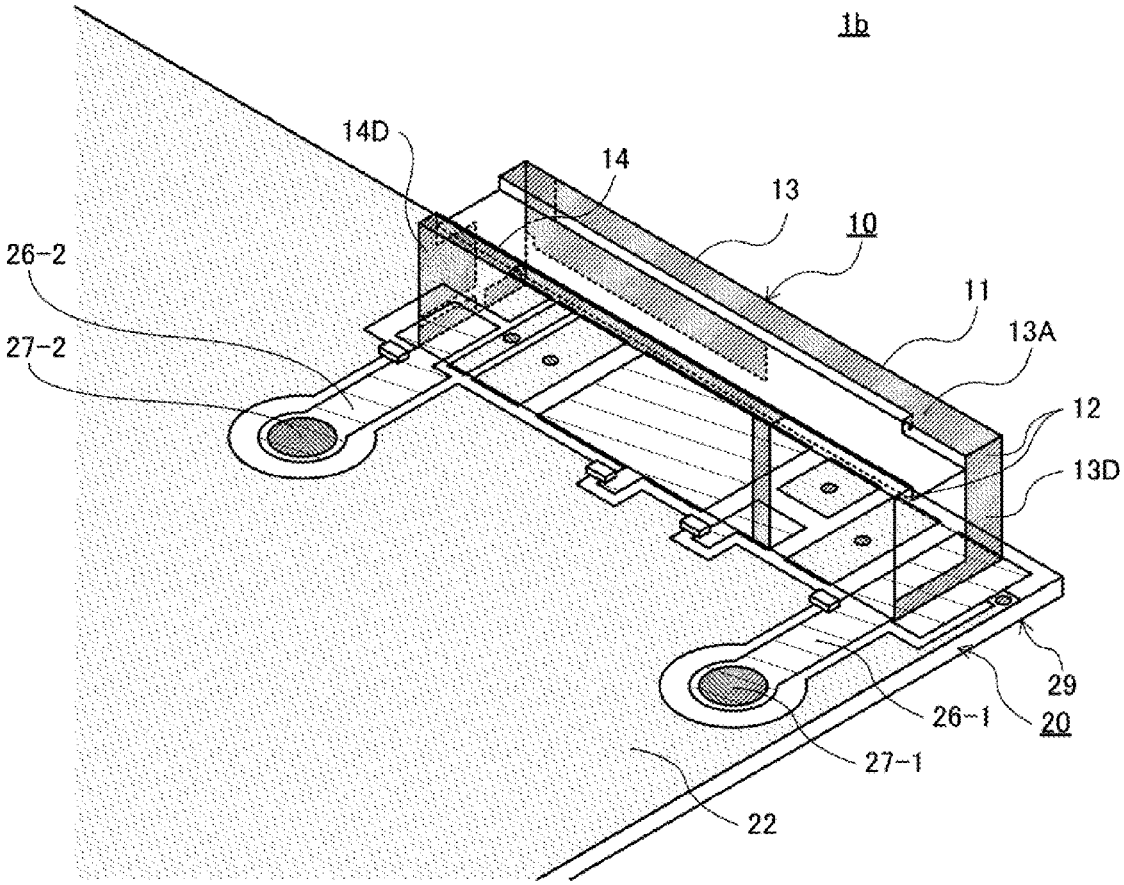
FIG. 5 is a perspective view showing the configuration of an antenna device according to a second embodiment of the present invention.
Figure 6:
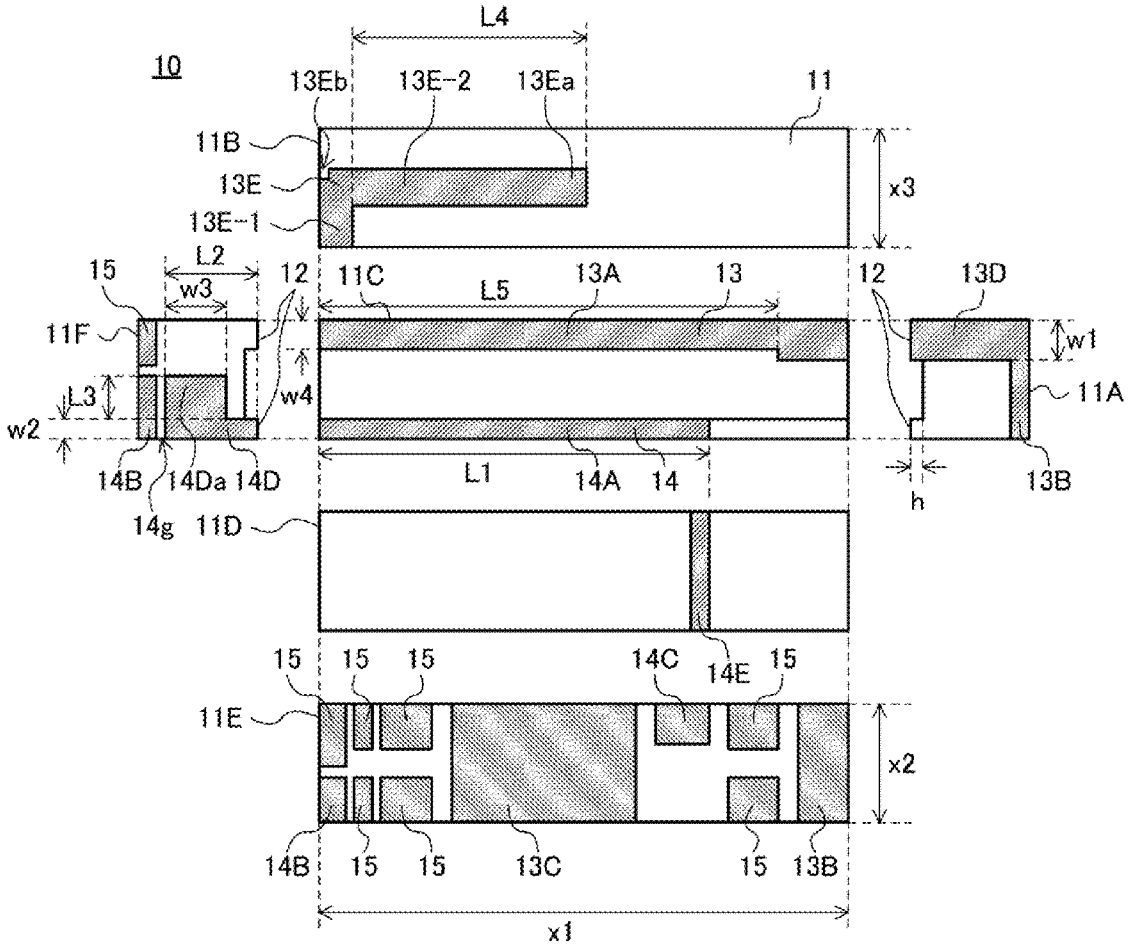
FIG. 6 is a developed view of the surface-mounted antenna according to the second embodiment of the present invention.
Figure 7A:
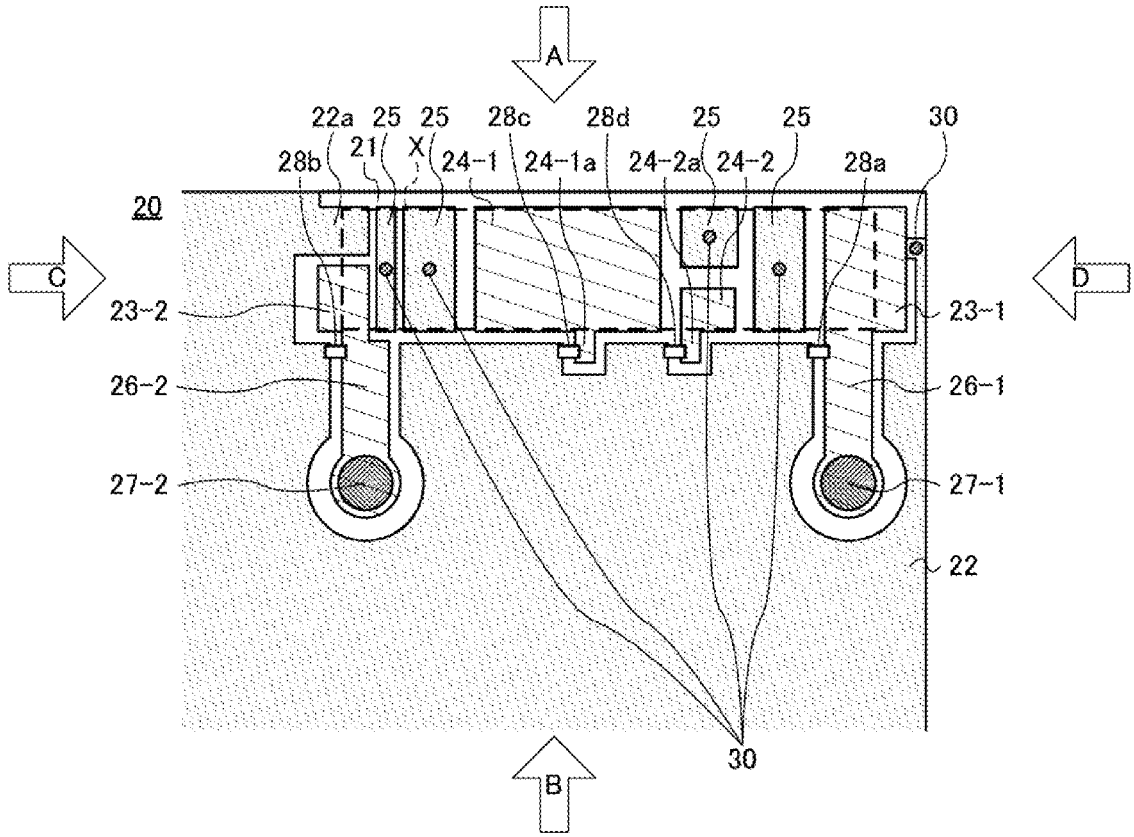
Figure 7B:
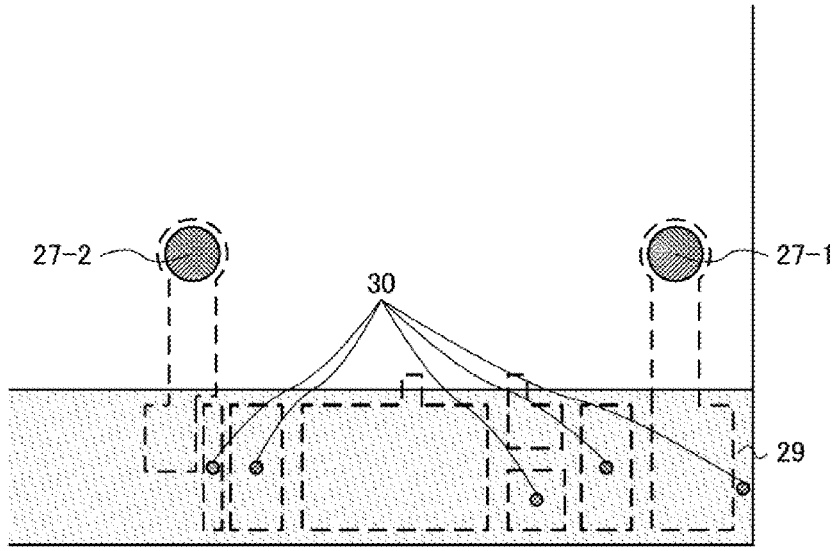
Figure 8A:
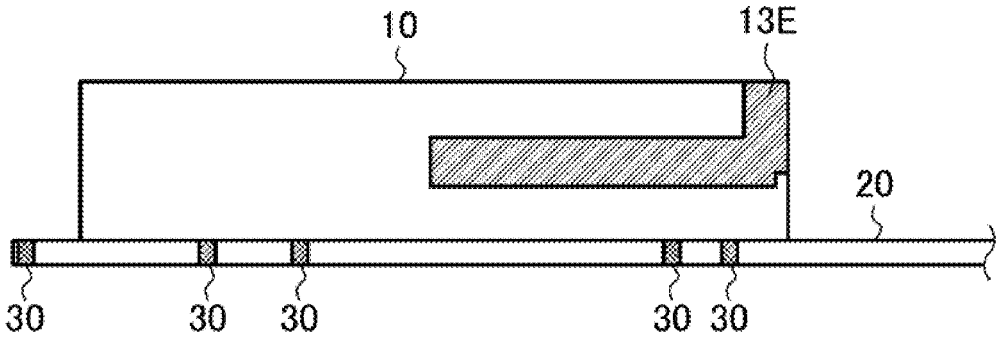
FIGS. 8A, 8B, 8C, and 8D are substantially perspective views in which the vicinity of the surface-mounted antenna of the antenna device according to the second embodiment of the present invention is seen from four directions of the side surfaces of the substrate.
Figure 8B:
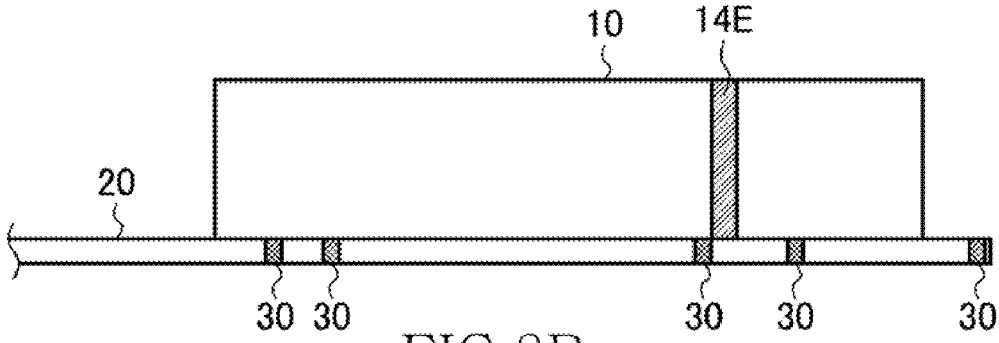
Figure 8C:
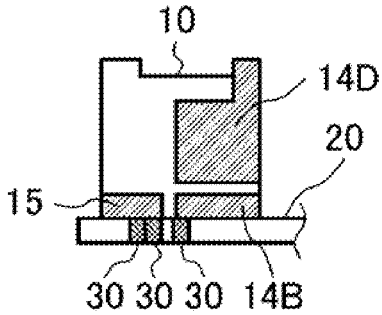
Figure 8D:
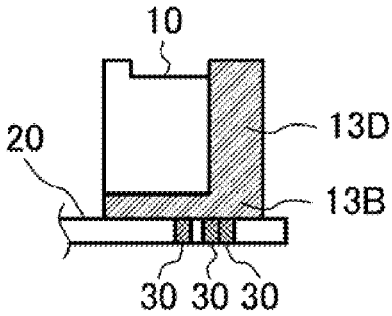

FIG. 5 is a perspective view showing the configuration of an antenna device 1*b* according to a second embodiment of the present invention. FIG. 6 shows a developed view of the surface-mounted antenna 10 configuring the antenna device 1*b*. FIGS. 7A and 7B show plan views showing the configuration of the substrate 20 configuring the antenna device 1*b*. FIG. 7A is a plan view of the face side of the substrate 20. FIG. 7B is a plan view of the back side of the substrate 20.

The antenna device 1*b* forcefully guides an electric current flowing through each of the conductors on the base 11 to the ground in the antenna device 1*a* and attempts to reduce the interference of an electromagnetic field between the antenna elements 13 and 14. This is realized by providing plural land patterns at a ground potential in the provided region X.

Specifically, as shown in FIGS. 5, 7A, and 7B, a large number of land patterns 25 in a floating state which is not connected to other patterns are provided on the face side of the substrate 20. The space for providing the land patterns 25 is secured by reducing the areas of the land patterns 23-1 and 23-2, and 24-1 and 24-2. Each of the land patterns 25 and the ground pattern 29 on the back side are connected by a throughhole conductor 30. The throughhole conductor 30 is preferably provided near the center of each of the land patterns 25.

To make the land patterns 25 be at a ground potential, as described above, the throughhole conductor 30 is used to prevent the wiring on the face side from becoming complicated. Where possible, the land patterns 25 and the ground pattern 22 on the face side may be directly connected without using the throughhole conductors 30. FIG. 7A also shows the thus-provided land patterns. In the example of FIG. 7A, a portion of the ground pattern 22 is extended into the ground clearance region 21 (an extended portion 22*a*). The extended portion 22*a* functions as one of the land patterns at a ground potential.

The ground patterns 22 and 29 may be connected by the throughhole conductor 30. In this case, as shown in FIGS. 5, 7A, and 7B, the throughhole conductor 30 is preferably provided near the contacted portion of the land pattern 23-1 and the ground pattern 22.

FIGS. 8A, 8B, 8C, and 8D are substantially perspective views in which the vicinity of the surface-mounted antenna 10 of the antenna device 1*b* is seen from four directions of the side surfaces of the substrate 20. FIGS. 8A, 8B, 8C, and 8D correspond to a direction A, a direction B, a direction C, and a direction D shown in FIG. 7A. In FIGS. 8A, 8B, 8C, and 8D, only the throughhole conductors 30 are shown by perspective views and other configurations are shown by plan views. As shown in FIGS. 8A, 8B, 8C, and 8D, the throughhole conductors 30 penetrate through the substrate 20 and electrically connect the patterns on the face side and the patterns on the back side.

As shown in FIGS. 5 and 6, on the side of the surface-mounted antenna 10, the conductor 15 which is not contacted with other conductors on the surface of the base 11 is provided in the position corresponding to each of the land patterns 25. The conductor 15 and the land pattern 25 are solder connected. The surface potential of the base 11 is reliably a ground potential. For convenience of manufacture, it is preferable that the conductor 15 be not provided in the position of the throughhole conductor 30.

As described above, in the antenna device 1*b*, the plural land patterns 25 at a ground potential are provided in the provided region X. The interference of an electromagnetic field between the antenna elements 13 and 14 can be reduced.

Figure 9:
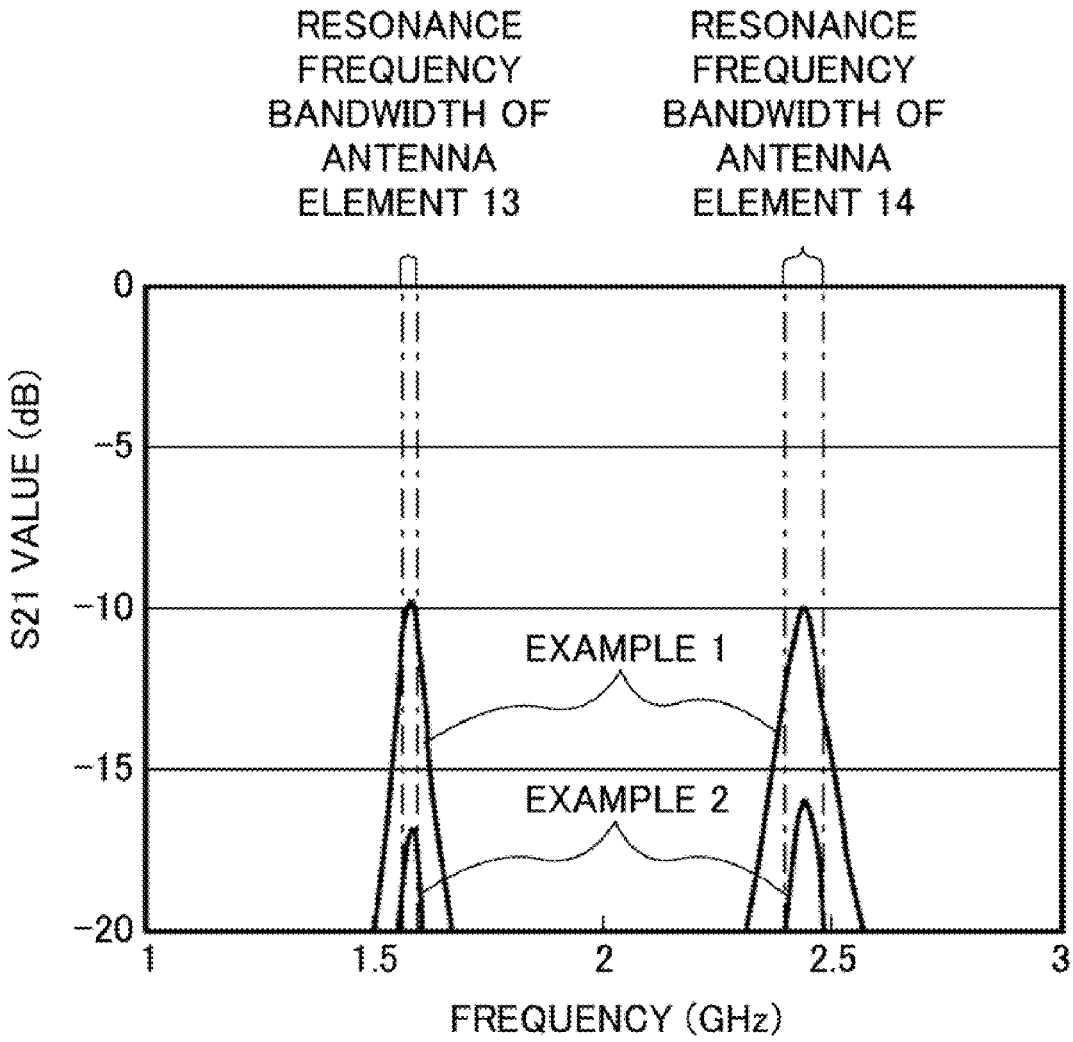
FIG. 9 is a graph showing the comparison of the characteristic of the surface-mounted antenna according to the second embodiment of the present invention (Example 2) and the characteristic of the surface-mounted antenna according to the first embodiment of the present invention (Example 1)

FIG. 9 is a graph showing the comparison of the characteristic of the surface-mounted antenna 10 according to this embodiment (Example 2) and the characteristic of the surface-mounted antenna 10 according to the first embodiment (Example 1) shown in FIG. 4. The horizontal axis and the vertical axis are similar to FIG. 4.

When the characteristic of Example 2 is measured, the lengths and the like of the respective portions are adjusted to obtain the best characteristic. Specifically, x1=14 mm, x2=3 mm, x3=3 mm, w1=1.0 mm, w2=0.5 mm, L1=10.2 mm, L2=2.2 mm, L3=1.0 mm, L4=6.2 mm, L5=12.0 mm, h=0.2 mm, and the widths of the gaps 13*g* and 14*g* are 0.5 mm and 0.3 mm, respectively. A thickness w3 of the extended portion along the gap 14*g* of the conductor 14D is larger than w2 and is 1.3 mm. As shown in FIG. 6, a notch 13Eb is provided near the folded portion of the conductor 13E. The portion of the conductor 13C formed on the side surface 11B is removed. The width w4 of a portion of the radiation electrode 13A (the portion having a length L5 (<x1)=1.0 mm from the side surface 11F) is smaller than w1 and is 0.9 mm. This is realized by reducing the width of a portion of the convex surface 12.

As shown in FIG. 9, the S21 values of Example 2 are smaller than those of Example 1 in the entire range (1 to 3 GHz) of the measured frequencies including the resonance frequency bandwidths of the antenna elements 13 and 14. From this, it is understood that in Example 2, the interference of an electromagnetic field between the antenna elements 13 and 14 is smaller than Example 1.

The numbers and positions of the throughhole conductors 30 and the land patterns 25 are determined by the experiment so as to obtain the best characteristic. The numbers and positions of the throughhole conductors 30 and the land patterns 25 shown in this embodiment are considered to be optimum according to the currently advanced experiment. The experiment results can vary due to various factors. The present invention does not mean that the numbers and positions of the throughhole conductors 30 and the land patterns 25 shown in this embodiment are absolutely optimum. The numbers and positions of the throughhole conductors 30 and the land patterns 25 can take various forms other than those shown in this embodiment.

The preferred embodiments of the present invention have been described above. The present invention is not limited to such embodiments. Needless to say, the present invention can be embodied by various forms in the scope without departing from its purport.

What is claimed is:

1. A surface-mounted antenna comprising:

a base having a substantially rectangular parallelepiped shape;

a first antenna element formed on the base and comprising a first radiation electrode that is coupled to a direct power supply; and a second antenna element formed on the base and comprising a second radiation electrode that is coupled to a capacitive coupling power supply, the base comprising convex surfaces on surfaces on which the first and second radiation electrodes are formed, the convex surfaces protruding with respect to a different portion of the base, the first and second radiation electrodes being provided on the convex surfaces.

2. The surface-mounted antenna as claimed in claim 1, wherein the first antenna element further comprises a first power supply electrode that directly connects a first power supply line formed on a substrate on which the surface-mounted antenna is provided and the first radiation electrode, and the second antenna element further comprises a second power supply electrode that connects a second power supply line formed on the substrate and the second radiation electrode via a gap.

3. The surface-mounted antenna as claimed in claim 2, further comprising:

a first ground pattern, connected to the first power supply line, formed on the substrate, and wherein the first antenna element further comprises a first conductor comprising one end in contact with the first radiation electrode and an other end not in contact with other conductors, the second antenna element further comprises a second conductor that connects the second radiation electrode and the first ground pattern, the second power supply electrode is formed on a first surface of the base, and the first conductor is formed on a second surface orthogonal to the first surface of the base.

4. The surface-mounted antenna as claimed in claim 3, wherein the first and second radiation electrodes extend in parallel with each other from one end of the substrate to an other end of the substrate, and the first power supply electrode and the second conductor contact the first and second radiation electrodes in portions closer to an other end of the base, respectively.

5. An antenna device comprising:

a substrate; and a surface mounted antenna on the substrate, wherein the surface-mounted antenna comprises:

a base having a substantially rectangular parallelepiped shape;

a first antenna element formed on the base and comprising a first radiation electrode that is coupled to a direct power supply; and a second antenna element formed on the base and comprising a second radiation electrode that is coupled to a capacitive coupling power supply, the base comprising convex surfaces on surfaces on which the first and second radiation electrodes are formed, the convex surfaces protruding with respect to a different portion of the base, the first and second radiation electrodes being provided on the convex surfaces.

6. The antenna device as claimed in claim 5, wherein the substrate comprises a plurality of land patterns at a ground potential in a region of the surface-mounted antenna.

7. The antenna device as claimed in claim 6, wherein the substrate comprises:

a second ground pattern on a back side of the substrate; and a plurality of throughhole conductors configured to connect the second ground pattern and a face side thereof of the substrate, wherein each of the plurality of land patterns is connected to the second ground pattern by any one of the plurality of throughhole conductors.

8. Radio communication equipment comprising an antenna device wherein the antenna device comprises:

a substrate; and a surface mounted antenna on the substrate, wherein the surface-mounted antenna comprises:

a base having a substantially rectangular parallelepiped shape;

a first antenna element formed on the base and comprising a first radiation electrode that is coupled to a direct power supply; and a second antenna element formed on the base and comprising a second radiation electrode that is coupled to a capacitive coupling power supply, the base comprising convex surfaces on surfaces on which the first and second radiation electrodes are formed, the convex surfaces protruding with respect to a different portion of the base, the first and second radiation electrodes being provided on the convex surfaces.

9. A surface-mounted antenna, comprising:

a substrate;

a base formed having a substantially rectangular parallelepiped shape;

a first antenna element formed on the base, comprising:

a first radiation electrode coupled to a direct power supply;

a first power supply electrode directly connecting a first power supply line formed on the substrate and the first radiation electrode; and a first conductor comprising one end in contact with the first radiation electrode and an other end not in contact with other conductors;

a first ground pattern, connected to the first power supply line, formed on the substrate; and a second antenna element formed on the base, comprising:

a second radiation electrode coupled to as capacitive power supply;

a second power supply electrode connecting a second power supply line formed on the substrate and the second radiation electrode via a gap, the second power supply electrode being formed on a first surface of the base, the first conductor being formed on a second surface orthogonal to the first surface of the base; and a second conductor connecting the second radiation electrode and the first ground pattern, wherein the first and second radiation electrodes extend in parallel with each other one end of the substrate to an other end the substrate, and the first power supply electrode and the second conductor contact the first and second radiation electrodes in portions closer to an other end of the base, respectively.

* * * * *